US010352060B2

(12) United States Patent
Gövert et al.

(10) Patent No.: US 10,352,060 B2
(45) Date of Patent: Jul. 16, 2019

(54) CONNECTION ELEMENT AND METHOD FOR PRODUCING SAME

(71) Applicant: THYSSENKRUPP STEEL EUROPE AG, Duisburg (DE)

(72) Inventors: Michael Gövert, Köln (DE); Stephan Drewes, Mönchengladbach (DE); Adrian Paton, Dinslaken (DE); Konstantinos Savvas, Düsseldorf (DE); Mark Hirt, Bochum (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 0 days.

(21) Appl. No.: 15/023,842

(22) PCT Filed: Sep. 11, 2014

(86) PCT No.: PCT/EP2014/069361
§ 371 (c)(1),
(2) Date: Mar. 22, 2016

(87) PCT Pub. No.: WO2015/043968
PCT Pub. Date: Apr. 2, 2015

(65) Prior Publication Data

US 2016/0215517 A1 Jul. 28, 2016

(30) Foreign Application Priority Data

Sep. 24, 2013 (DE) ..... 10 2013 110 528

(51) Int. Cl.
*B21D 22/16* (2006.01)
*E04H 12/08* (2006.01)
(Continued)

(52) U.S. Cl.
CPC ..... *E04H 12/085* (2013.01); *B21D 22/16* (2013.01); *B21D 39/046* (2013.01); *E04H 12/10* (2013.01)

(58) Field of Classification Search
CPC ..... B21D 19/046; B21D 22/14; B21D 22/16; B21D 22/18; B21D 51/10; B21D 39/04;
(Continued)

(56) References Cited

U.S. PATENT DOCUMENTS 3,029,667 A * 4/1962 Sporck ..... B21D 22/16 72/105
3,046,924 A * 7/1962 Kanc ..... B21D 22/16 29/894.325
(Continued)

FOREIGN PATENT DOCUMENTS

CN 202861128 U 4/2013
CN 103402664 A 11/2013
(Continued)

OTHER PUBLICATIONS

Int'l Search Report for PCT/EP2014/069361 dated Dec. 22, 2014 (dated Jan. 13, 2015).
(Continued)

*Primary Examiner* — Edward T Tolan
(74) *Attorney, Agent, or Firm* — RMCK Law Group PLC

(57) ABSTRACT

Methods for producing connecting or junction elements, which in some cases may be utilized in steel structures of towers for wind turbines, may involve using a flow forming process to produce which a flange and a casing integrally adjoining the flange from a blank. Further, an end of the casing opposite the flange may be adapted to a contour of a component to which the casing is intended to be connected. In some examples, the casing may be formed with a second
(Continued)

flange. Likewise, in some examples, at least a portion of the casing may have a conical design.

11 Claims, 3 Drawing Sheets

(51) Int. Cl.
*B21D 39/04* (2006.01)
*E04H 12/10* (2006.01)

(58) Field of Classification Search
CPC ..... B21D 39/044; B21D 39/046; B21H 1/04; E04H 12/085
See application file for complete search history.

(56) References Cited

U.S. PATENT DOCUMENTS 3,120,206 A * 2/1964 Sporck ..... B21D 22/16 29/890.01
3,184,940 A * 5/1965 Sporck ..... B21D 22/16 72/348
3,205,688 A 9/1965 Paulton
3,823,591 A 7/1974 Schroder
3,995,474 A * 12/1976 Kraft ..... B21D 22/16 29/892.2
4,055,976 A * 11/1977 Kraft ..... B21D 22/16 29/892.3
4,117,704 A * 10/1978 Nakache ..... B21D 19/046 72/83
5,428,980 A * 7/1995 Iidaka ..... B21D 22/16 72/83
5,531,088 A * 7/1996 Inatani ..... B21H 1/04 72/82
5,931,037 A * 8/1999 Yamada ..... B21D 22/16 72/68
6,484,401 B1 * 11/2002 Specht ..... B21D 22/16 29/892
6,647,839 B2 * 11/2003 Yoshitome ..... B21D 22/14 72/71
8,359,893 B2 * 1/2013 Pascual Barrio ..... B60R 19/34 72/367.1
2006/0272378 A1 * 12/2006 Amino ..... B21D 22/16 72/305
2013/0247635 A1 9/2013 Huetter
2015/0107181 A1 * 4/2015 Larsen ..... E04B 1/1903 52/655.1
2015/0152664 A1 * 6/2015 Larsen ..... B21C 37/296 52/651.07
2016/0101455 A1 4/2016 Sakane

FOREIGN PATENT DOCUMENTS

CN 105163881 A 12/2015
DE 4400257 C1 12/1994
DE 102006020999 A1 11/2007
DE 102007038784 A1 2/2009
EP 2270294 A2 1/2011
GB 2419150 A 4/2006
WO 2014005789 A1 1/2014

OTHER PUBLICATIONS

German Language International Preliminary Report on Patentability (CH II) for International patent application No. PCT/EP2014/069361; dated Dec. 7, 2015.
English Translation of International Preliminary Report on Patentability (CH II) for International patent application No. PCT/EP2014/069361; dated Dec. 7, 2015.
English abstract for CN202861128U.

* cited by examiner

CONNECTION ELEMENT AND METHOD FOR PRODUCING SAME

CROSS REFERENCE TO RELATED APPLICATIONS

This application is a U.S. National Stage Entry of International Patent Application Serial Number PCT/EP2014/069361, filed Sep. 11, 2014, which claims priority to German Patent Application No. DE 102013110528.9 filed Sep. 24, 2013, the entire contents of both of which are incorporated herein by reference.

FIELD

The present disclosure relates to connecting or junction elements and, more particularly, to connecting or junction elements for steel structures of towers and methods of producing such connecting or junction elements.

BACKGROUND

On masts and towers, in particular on wind turbines or voltage masts, struts are generally connected at different heights and angles to substantially upright mast structures, such as corner posts.

For this purpose, it is known in the prior art to construct welded structures consisting of individual metal sheets, as connecting elements. In particular, the weld seams give rise to metallurgical notches and, as a result, to a low endurance limit. In addition, a multiplicity of individual parts and therefore an accumulation of weld seams in the fatigue-stressed region and a high outlay on installation and logistics are associated with such a structure. Such a construction is basically known from EP 2 270 294 A2.

Furthermore, it is known to produce connecting elements as cast parts. However, the production thereof is complicated and costly. Furthermore, there is the risk of material inhomogeneities, shrinkage cavities and, in the case of repairs, the problem of only very limited weldability, if any at all, for repair weldings.

Therefore, one example object of the present disclosure is to provide components, such as connecting or junction elements, for instance, that avoid the disadvantages mentioned above.

DETAILED DESCRIPTION

Figure 1:
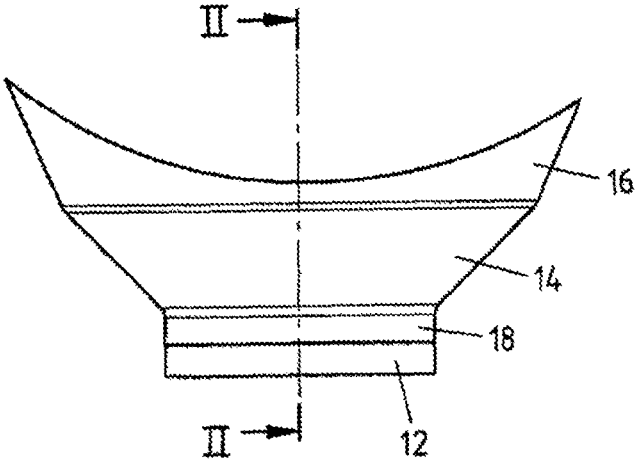
FIG. 1 is a side view of an example connecting element.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

According to some example methods, a flange and a casing integrally adjoining the flange are produced from a blank by means of a flow forming process. Subsequently, an end of the casing which is opposite the flange is adapted to a contour of the component to which the casing is intended to be connected. In some examples, a circular blank, a tubular section, or a forged blank is used as the blank.

Flow forming is understood as meaning a manufacturing method of forming technology, which serves to produce generally rotationally symmetrical hollow bodies.

During the spinning, a circular shaped-metal blank, the "circular blank", is clamped in front of the end side of a mandrel. The mandrel here constitutes the tool shaping the geometry of the component internally. The mandrel is then set into rotation together with the circular blank by the main spindle drive of the spinning machine.

The actual forming of the circular blank into the component takes place in a plurality of steps by means of a spinning tool which, for example, is moved step by step from the center of the circular blank to the edge and back again. By the progression of this movement in the axial direction, the circular blank gradually approximates the geometry of the mandrel. In industrial processes, a spinning roller is frequently used as a tool, and the movement is carried out under computer control.

Connecting or junction elements which can be readily connected to adjacent components, have an improved force flow in comparison to the prior art and can be produced advantageously are therefore provided according to the invention. In addition, the connection of the connecting element in the desired position can be made possible by the end opposite the flange being respectively adapted. Various sizes and lengths which, with corresponding trimming, also permit positioning at a great angle are likewise possible. A further advantage of the invention consists in that the connecting elements produced according to the invention do not have any weld seam, such as, for example, components produced by bending, and therefore the notch effect is reduced. The advantages of the present invention accordingly consist in the reduction in the number of parts, the omitted weld seam in the flange region and the improved force flux.

Furthermore, it is preferred to increase or to reduce the material thickness of the flange in relation to the material thickness of the blank by ironing or thrust during the flow forming. In particular, the transition between the flange and the casing is formed here with a flowing wall thickness. Particular advantages are achieved by the individual adjustability of the wall thickness in the various regions of the connecting element. In particular, the internal pressure stresses introduced into the structure by the flow forming process can be adjusted and therefore significantly improve the endurance limit.

In a furthermore preferred manner, the flange is formed located on the inside. In this case, it is preferred to use a circular blank as a blank. By means of the flow forming, the material thickness at the flange can be adjusted by ironing or thrust of material from adjacent regions, in particular from regions dispensed with during the subsequent trimming. By this means, the stability of the flange located on the inside is increased and at the same time the amount cut is reduced.

Alternatively thereto, the flange can be formed located on the outside. In this case, it is preferred to use a tubular section or a forged blank as the blank. A tapering transition region is then formed on the inside as a casing which is welded to an end of a mast structure, in particular a corner post.

Furthermore, the casing is formed conically, wherein the flange is formed at the tapered end of the casing. As a result, a particularly stable structure is achieved by the widened end of the casing being connected with a larger cross section to the mast structure, while the cross section of the flange is adapted to the strut to be attached.

In a preferred manner, that end of the casing which is opposite the flange is adapted to the outer contour of the component by trimming, for which purpose use is made in particular of cutting with a laser or water jet, or plasma or flame cutting. After the trimming, the open end of the preferably conical casing can therefore be welded onto the outer contour of the mast structure, in particular the corner post.

It is likewise possible to provide that end of the casing which is opposite the flange with a further flange. In this case, the connecting element has a flange on both sides of the casing, wherein the first flange is provided for connecting to a strut and the further flange is provided for connecting to a mast structure or to a corner post.

It is furthermore preferred here for the further flange to be formed by flow forming, as a result of which the above-described advantages are also obtained at this end of the casing.

Very generally and independently of the specific configuration as a connecting or junction element, the described method can also be used to produce flange connections for any desired pipes. This use affords the same advantages in respect of material thicknesses and stress properties. For outer flanges, the use of a tubular section or forged blank is also appropriate here, instead of a circular blank for the flow forming process for an inner flange. Furthermore, the method is limited in respect of the dimensions only by the size of the flow forming machine. A machine of corresponding size would also be capable of producing the flanges for the tower main tubes, in particular for wind turbines.

The object presented above is also achieved according to the invention by a connecting element, in particular for steel structures of towers, preferably for wind turbines, with a flange, and with a casing, wherein the casing integrally adjoins the flange, and wherein that end of the casing which is opposite the flange is adapted to the contour of the component to which the casing is intended to be connected.

With this construction, the same advantages are obtained as have been explained previously with reference to the method according to the invention.

FIGS. 1 to 4 illustrate a first exemplary embodiment of a connecting or junction element 10 according to the invention.

The connecting or junction element 10 illustrated, only called connecting element below, is suitable in particular for steel structures of towers, preferably for wind turbines, and is produced in particular by a method according to the invention.

The connecting element 10 has a flange 12 and a casing 14, wherein the casing 14 integrally adjoins the flange 12, and wherein that end of the casing 14 which is opposite the flange 12 is adapted to the contour of the component of a steel structure, in particular of a tubular corner post 30 with a round or polygonal cross section, to which the casing 14 is intended to be connected.

In the present case, the casing 14 has a conical shape which has a section 16 likewise extending conically, but with a shallower angle. The flange 12 is connected here to the tapered end of the conical casing 14.

Furthermore, a cylindrical section 18 is provided which connects the flange 12 to the casing 14 and 16.

In the exemplary embodiment illustrated, the flange 12 is formed located on the inside and forms an opening 20. Struts of a steel structure can be connected in a customary manner to the flange 12. The opening of the casing 14 or of the section 16, which opening is opposite the flange 12, is adapted for contact with a cylindrical structure, that, for example, of a tubular corner post 30. The connecting element 10 can be welded to the corner post 30 along the outer edge of the casing 14 or of the section 16.

Figure 2:
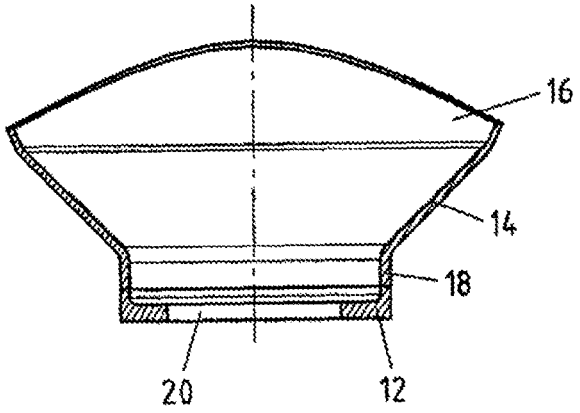
FIG. 2 is a cross-sectional view taken across line II-II of the example connecting element of FIG. 1.
Figure 3:
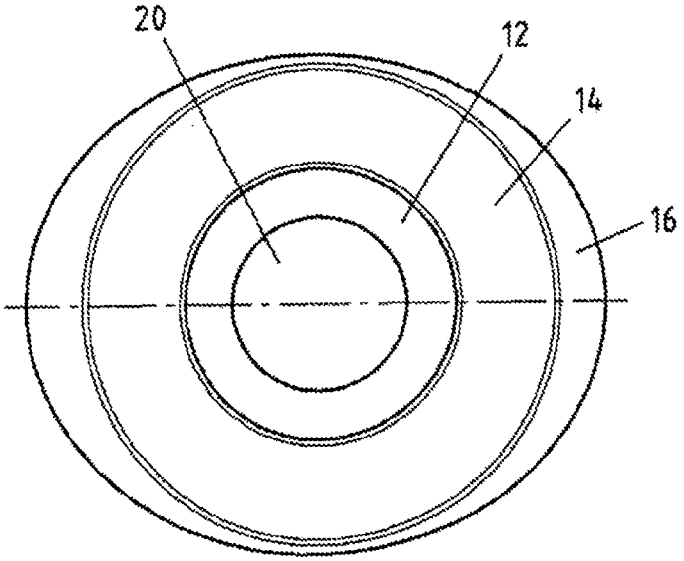
FIG. 3 is a top view of the example connecting element of FIGS. 1-2.
Figure 4:
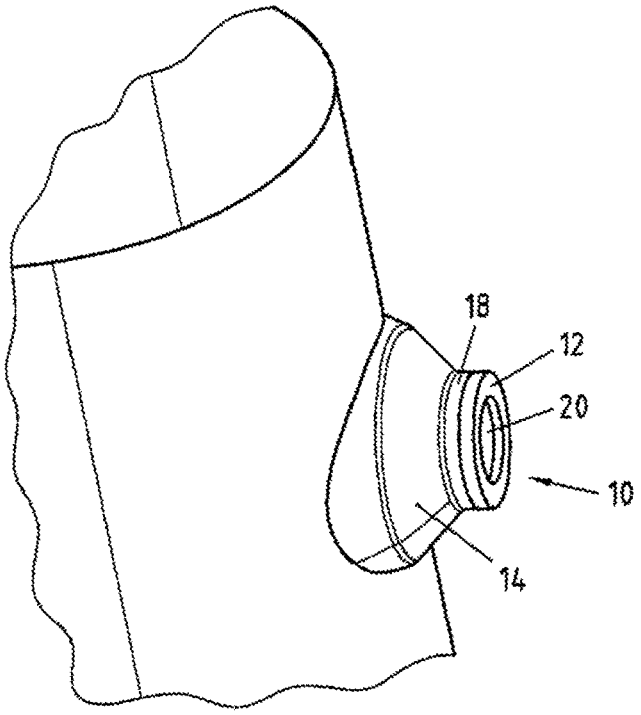
FIG. 4 is a perspective view of the example connecting element of FIGS. 1-3 shown in a state connected to an example tube.

As emerges in particular from FIG. 4, in the case of the exemplary embodiment illustrated in FIGS. 1 to 3, the axis of the connecting element 10 is oriented substantially perpendicularly to the axis of the corner post 30.

Figure 5:
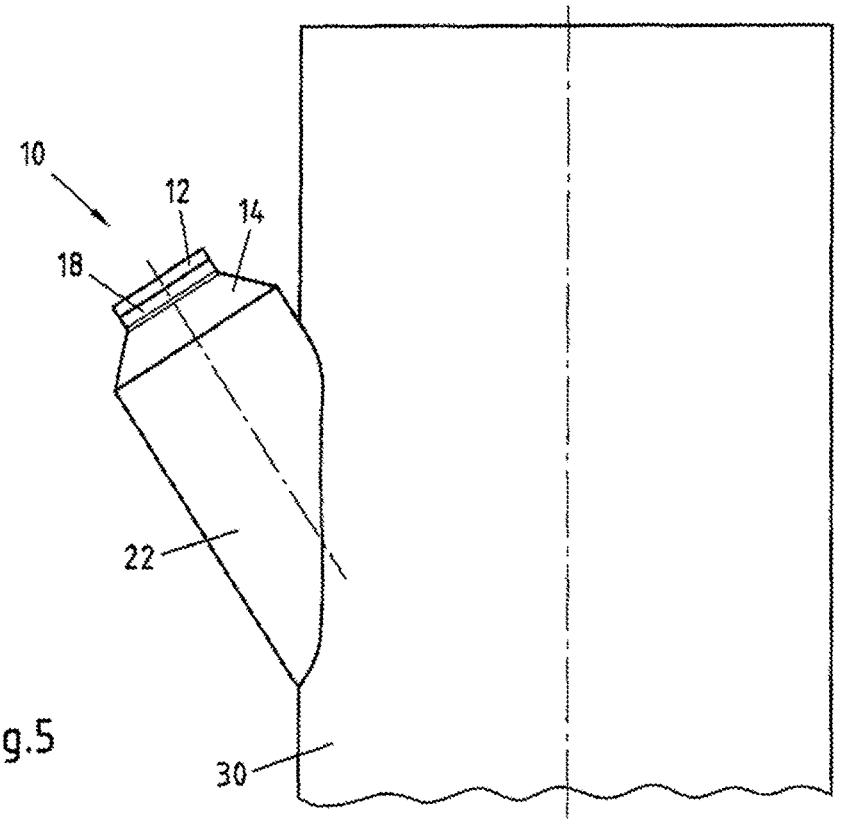
FIG. 5 is a sectional view of an example connecting element in a state connected to a tube.

FIG. 5 now shows a further exemplary embodiment of a configuration according to the invention of the connecting element 10. In this exemplary embodiment, the casing 14 has a cylindrical section 22 which is severed obliquely with respect to the axis of the connecting element 10. The connecting element 10 can therefore be connected to the corner post 30 at an angle.

Figure 6:
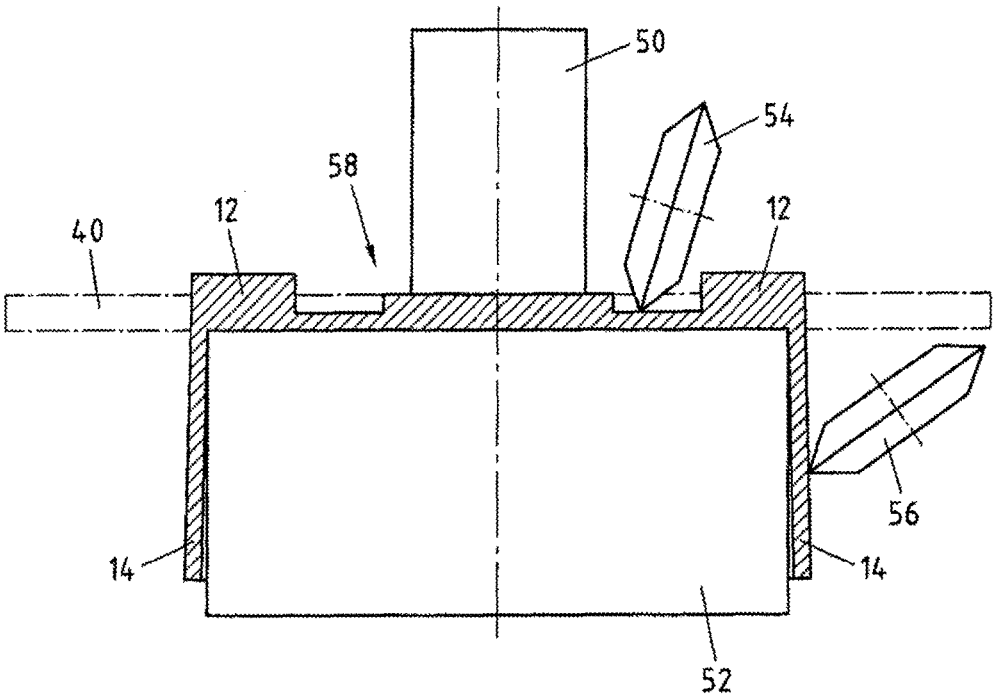
FIG. 6 is a schematic view of an example method for producing a connecting element for steel structures of towers.

FIG. 6 shows, in a schematic illustration, the basic sequence of a method according to the invention for producing a connecting or junction element 10, in particular for steel structures of towers, preferably for wind turbines, in which a flange 12 and a casing 14 integrally adjoining the flange 12 are produced from a blank 40 by means of a flow forming process.

Subsequently, that end of the casing 14 which is opposite the flange 12 is adapted to the contour of the component, for example of a corner post 30, to which the casing 14 is intended to be connected. This last step is not illustrated in the drawing.

In the present example, a circular blank 40 made of steel is used as the blank.

The circular blank 40 is clamped between a spindle 50 of a flow forming machine and a spindle 52 shaping the geometry of the connecting element 10 internally. With the spinning tools 54, 56 (illustrated schematically), the circular blank 40 is formed in such a manner that the desired shape of the connecting element 10 is achieved once the flow forming is ended.

In particular, FIG. 6 also shows the forming step with which the material thickness of the flange 12 is increased in relation to the material thickness of the circular blank 40 by thrust during the flow forming. The starting material of the circular blank 40 is thinner here than the subsequently formed flange 12. For this purpose, material is displaced from the subsequent, centrally arranged trimming 58 and a greater thickness of the flange 12 is thus produced. This has the particular advantage that less trimming 58 occurs from the center, and the ironed outer casing 14 can be produced from thinner material.

What is claimed is:

1. A method for producing a connecting element for steel structures of towers of wind turbines, the method comprising:

producing a flange and a casing integrally adjoining the flange from a blank by a flow forming process;

increasing a material thickness of the flange relative to a material thickness of the blank by thrust during the flow forming process;

trimming an end of the casing opposite the flange to a contour of a tubular corner post to which the casing is to be connected, wherein the contour of the tubular corner post to which the casing is trimmed is an outer contour of the tubular corner post; and connecting the end of the casing to the tubular corner post.

2. The method of claim 1 wherein the blank used to produce the flange and the casing is a circular blank, a tubular section, or a forged blank.

3. The method of claim 1 wherein producing the flange and the casing comprises forming a transition between the flange and the casing with a flowing wall thickness.

4. The method of claim 1 wherein producing the flange and the casing comprises forming the flange so as to extend radially inwardly from the casing.

5. The method of claim 1 wherein producing the flange and the casing comprises forming the flange so as to extend radially outwardly from the casing.

6. The method of claim 1 wherein producing the flange and the casing comprises forming the casing conically and forming the flange at a tapered end of the casing.

7. The method of claim 1 wherein a cross section of the flange is adapted to a strut to be attached.

8. The method of claim 1 wherein the connecting element is to be welded to the corner post along the outer edge of the casing.

9. The method of claim 1 further comprising forming a second flange on the end of the casing opposite the flange, wherein the second flange is formed by flow forming.

10. The method of claim 1 wherein the axis of the connecting element is to be oriented substantially perpendicularly to the axis of the corner post, or the casing has a cylindrical section which is severed obliquely with respect to the axis of the connecting element to be oriented to the corner post at an angle.

11. A connecting element for steel structures of towers for wind turbines produced according to the method of claim 1.

* * * * *